US006800012B2

(12) United States Patent
Maxim

(10) Patent No.: US 6,800,012 B2
(45) Date of Patent: Oct. 5, 2004

(54) PICTURE BOARD WITH ARRAY OF INDIVIDUALLY PIVOTABLE COLOR TRANSMISSION MEMBERS AND PIGMENT SHEET AND METHOD

(76) Inventor: John G. Maxim, 863 Coventry St., Boca Raton, FL (US) 33487

( * ) Notice: Subject to any disclaimer, the term of this patent is extended or adjusted under 35 U.S.C. 154(b) by 103 days.

(21) Appl. No.: 10/011,189

(22) Filed: Dec. 7, 2001

(65) Prior Publication Data

US 2003/0060122 A1 Mar. 27, 2003

Related U.S. Application Data

(60) Provisional application No. 60/316,595, filed on Aug. 31, 2001.

(51) Int. Cl.[7] ..... A63H 33/22

(52) U.S. Cl. ..... 446/219; 446/118; 446/485; 446/91; 40/548; 40/547; 40/579; 362/231; 362/252; 362/255; 362/456; 434/81; 434/96; 434/428

(58) Field of Search ..... 446/219, 118, 446/91, 485; 40/579, 451, 452, 547, 550, 548; 434/81, 428, 96; 362/252, 255, 231, 456; 273/237, 282.1

(56) References Cited

U.S. PATENT DOCUMENTS 2,096,360 A * 10/1937 Heller
3,530,615 A * 9/1970 Meyer
3,568,357 A * 3/1971 Lebensfeld
3,651,246 A * 3/1972 Bergero
4,139,841 A * 2/1979 Roberts
4,196,539 A * 4/1980 Speers
4,541,812 A * 9/1985 Katsumata ..... 446/91
5,391,105 A * 2/1995 Jones ..... 446/219
5,555,163 A * 9/1996 Pisani ..... 362/252
6,032,393 A * 3/2000 Maxim ..... 40/548
6,186,504 B1 * 2/2001 Maxim ..... 273/153
6,244,872 B1 * 6/2001 Hirayama ..... 434/81

* cited by examiner

*Primary Examiner*—Derris H. Banks
*Assistant Examiner*—Ali Abdelwahed
(74) *Attorney, Agent, or Firm*—Oltman, Flynn & Kubler

(57) ABSTRACT

An image generating apparatus includes a pigment sheet having an array of translucent pigment clusters, each pigment cluster being formed of a number of pigment regions, each pigment region containing an individual pigment differing in radiated color from that of a pigment in another pigment region within the pigment cluster; an image display board perforated by an array of light transmission member wells and positioned above the pigment sheet so that the member wells are located over and substantially register with a corresponding pigment cluster; a number of translucent light transmission members, each light transmission member being mounted within one of the member wells so that each light transmission member is movable within its corresponding member well relative to the pigment sheet to any one of various light transmission member positions to selectively receive a selected radiated color from one of the pigment regions; and at least one artificial light source mounted below the pigment sheet.

26 Claims, 15 Drawing Sheets

(4 of 15 Drawing Sheet(s) Filed in Color)

FIG. 9
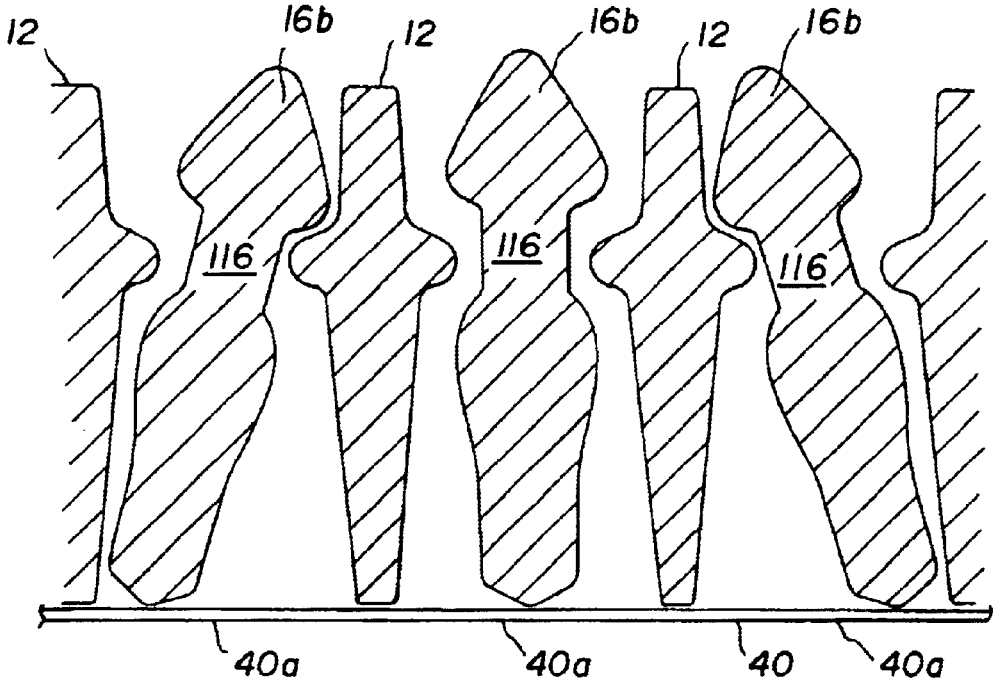
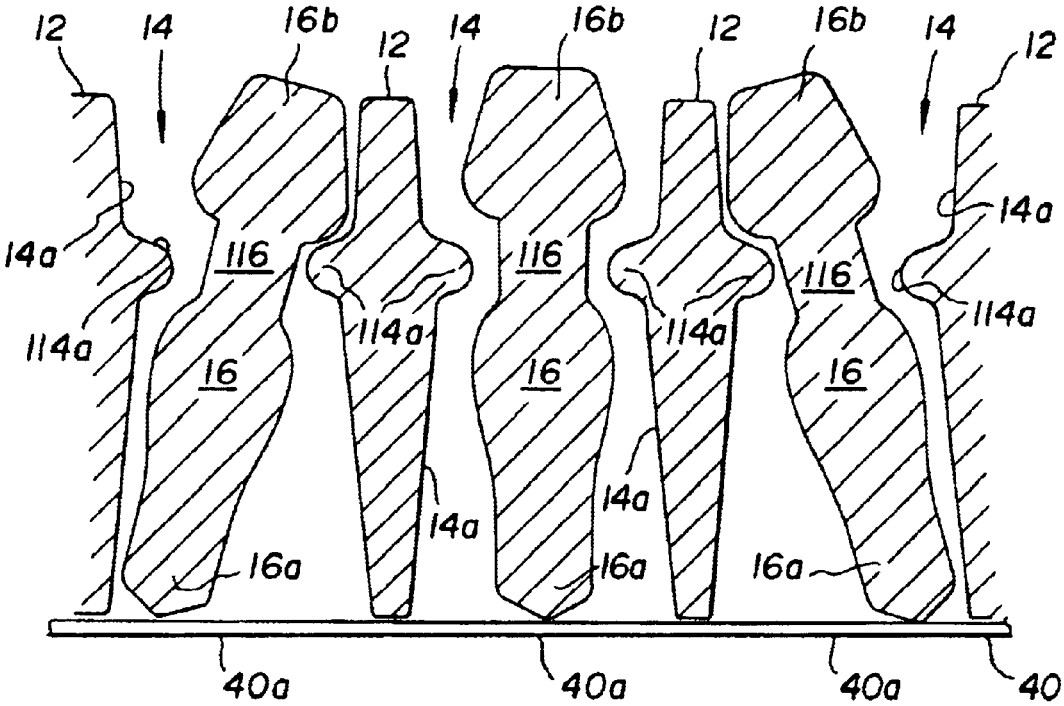
FIG. 10

FIG. 23
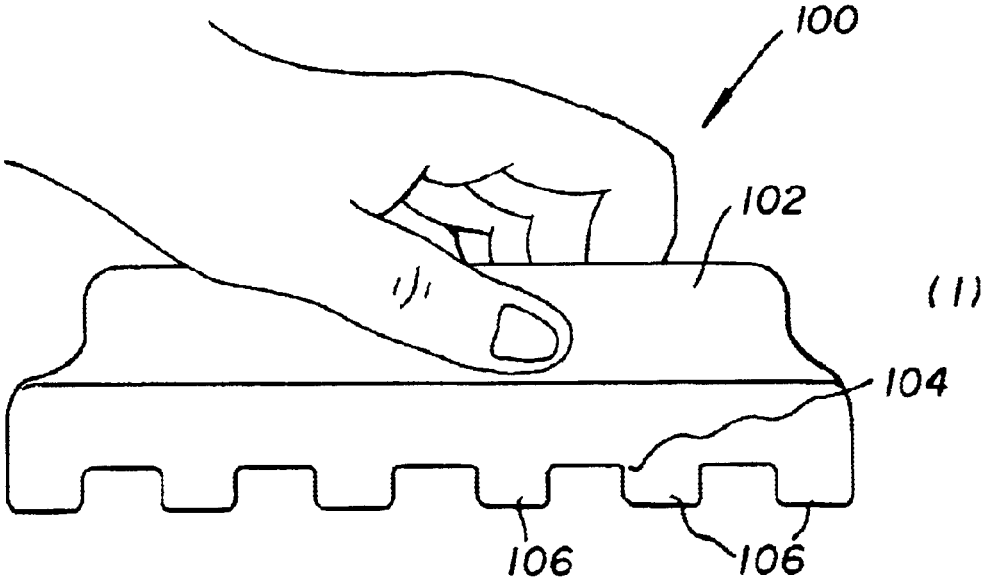
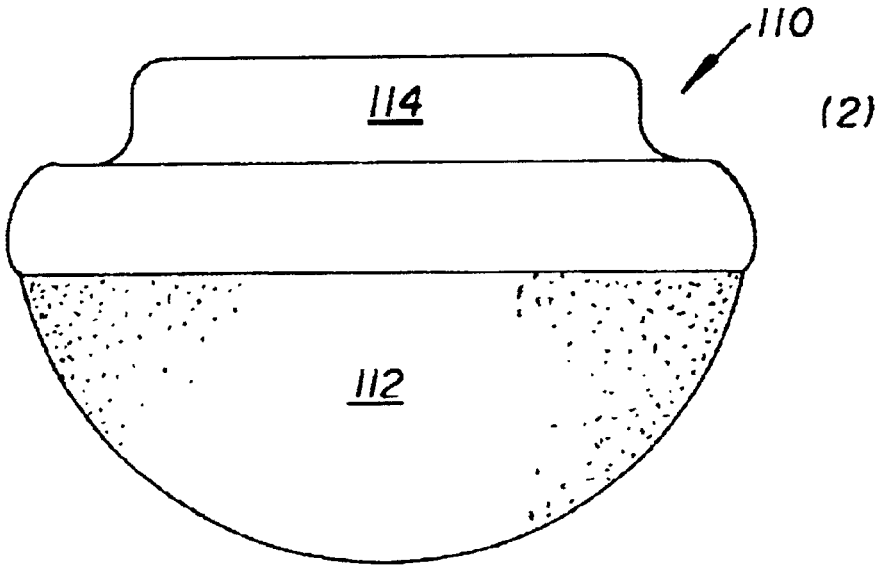
FIG. 24

PICTURE BOARD WITH ARRAY OF INDIVIDUALLY PIVOTABLE COLOR TRANSMISSION MEMBERS AND PIGMENT SHEET AND METHOD

FILING HISTORY

This application continues from provisional patent application No. 60/316,595 filed on Aug. 31, 2001.

BACKGROUND OF THE INVENTION

1. Field of the Invention

The present invention relates generally to the field of personal entertainment devices including toys. More specifically the present invention relates to an image generating apparatus including a pigment sheet having an array of pigment clusters, each pigment cluster being formed of several pigment regions, each pigment region containing an individual pigment differing in radiated color from another pigment region within the same pigment cluster. The apparatus further includes an image display board having an array of light transmission member wells, each well having a well bearing surface and containing a translucent colorless light transmission member, each member having a member light receiving end and a member light radiating end and a central member bearing surface being mounted within member well such that the member bearing surface rides against and is retained by the well bearing surface to make the light transmission member pivotable within the member well relative to the pigment sheet to cause the light receiving end to move over one of the pigment regions to selectively receive a radiated color from the pigment region. At least one artificial light source is mounted below the pigment sheet and the pigment sheet is translucent, so that light of a certain color frequency is transmitted into each light transmission member corresponding in color to the particular pigment region immediately adjacent the light receiving end of the particular light transmission member, so that the light transmission members radiate selected colors which collectively form an image.

A method of using the apparatus is provided, in which the player pivots the light transmission members one by one, or simultaneously in groups with a sweep of the hand or a sweep of a tool, until each member is illuminated with a selected color, and the collectively illuminated light transmission members form a desired pattern or picture.

2. Description of the Prior Art

There have long been board games in which various patterns are created from illuminated elements. These have taken the form of tinted and polarized sheet portions which are positioned one over the other to create desired patterns. A problem with these prior devices has been that in some instances the illumination elements have to be removed and thereby subjected to the possibility of loss to change the color or pattern. Another problem has been that the range of color choices for elements, whether mounted individually or overlaid with other elements, has been highly limited.

It is thus an object of the present invention to provide an image creating apparatus having lighted elements in the form of translucent light transmission structures capable of illumination in various colors to combine to form an image such as a pattern or a picture.

It is another object of the present invention to provide such an apparatus in which the light transmission structure color is changed without light transmission structure removal, so that no light transmission structures are lost and for greater ease of operation.

It is still another object of the present invention to provide such an apparatus which can produce color in a light transmission structure from virtually any point along the visible spectrum.

It is yet another object of the present invention to provide such an apparatus which can incorporate pre-set images by arranging the pigment regions within each of the various pigment clusters in a certain way, one such image can be displayed by sweeping the hand or other suitable object over the lighted elements in a first direction, and another such image can be displayed by sweeping the hand or other suitable object over the lighted elements in a second direction.

It is a still further object of the present invention to provide such an apparatus which includes tools for selective manipulation of color elements.

It is finally an object of the present invention to provide such an apparatus which is compact, light weight, easy to use and inexpensive to manufacture.

SUMMARY OF THE INVENTION

The present invention accomplishes the above-stated objectives, as well as others, as may be determined by a fair reading and interpretation of the entire specification.

An image generating apparatus is provided, including a pigment sheet having an array of translucent pigment clusters, each pigment cluster being formed of a number of pigment regions, each pigment region containing an individual pigment differing in radiated color from that of a pigment in another pigment region within the pigment cluster; an image display board perforated by an array of light transmission member wells and positioned above the pigment sheet so that the member wells are located over and substantially register with a corresponding pigment cluster; a number of translucent light transmission members, each light transmission member being mounted within one of the member wells so that each light transmission member is movable within its corresponding member well relative to the pigment sheet to any one of various light transmission member positions to selectively receive a selected radiated color from one of the pigment regions; and at least one artificial light source mounted below the pigment sheet; so that light of a certain color frequency is transmitted into each light transmission member corresponding in color to the particular pigment region immediately adjacent to the particular light transmission member.

Each light transmission member preferably includes a member side wall and a light pipe in the form of a light transmitting rod having a member light receiving end directed toward the pigment sheet and having a member light radiating end directed upwardly from the display board, for manual pivoting to orient the light transmission member within its member well; the light receiving end and the light radiating end being separated by a lateral irregularity in the member side wall defining a member bearing surface; and each member well additionally including a tubular well side wall extending through the display board within an annular lateral irregularity defining a well bearing surface within which the member bearing surface is pivotably mounted and retained.

The pigment clusters preferably include translucent pigment material. The pigment sheet preferably includes a sheet top surface and a sheet bottom surface and is transparent and the pigment material preferably is applied to the sheet bottom surface so that contact between the sheet top surface and the light transmission members does not abrade the pigment material.

The pigment regions forming each pigment cluster preferably are arranged in radially divided segments arrayed around a center point. The pigment regions within each pigment cluster optionally are discrete and sharply divided along radial lines. Alternatively the pigment regions blur over and into each other at edges of the pigment regions adjacent an edge of another pigment region. The portions of the pigment sheet directly above the pigment clusters optionally are each shaped as a concave and substantially spherical segment arching downwardly away from the light transmission member, and having a curvature substantially matching the pivot arch of the light receiving end of the corresponding light transmission member, so that the light receiving end remains a substantially fixed distance from the corresponding pigment cluster and the given light transmission member pivots with minimal friction resistance. The member light receiving ends are one of: convex and planar to gather as much light as possible through a given pigment region.

The apparatus preferably includes a mounting panel secured behind and bearing against the pigment sheet to cause the pigment sheet to retain its shape; and the mounting panel preferably is substantially rigid and planar, and optionally has concave radial depressions positioned and sized to correspond to and receive the concave and semi-spherical segments and the pigment clusters. The pigment sheet alternatively is entirely planar, and the member light receiving ends each rest and ride on the pigment sheet, and each member light receiving end tapers to a tip of reduced diameter relative to the remainder of the given light transmission member, to be unstable when resting in a vertical position on the pigment sheet. The apparatus optionally additionally includes a mounting panel secured behind and bears against the pigment sheet to cause the pigment sheet to retain its shape, and the mounting panel is substantially rigid and planar; and the mounting panel is secured behind and bears against the pigment sheet to cause the pigment sheet to retain a planar shape.

Pigment regions of the same colors optionally are provided in each pigment cluster, and the pigment regions for each given color are oriented in the same direction within every pigment cluster for cluster uniformity. Each light receiving end preferably is longer and therefore heavier than each light radiating end so that tilting the apparatus causes gravity to tilt the light transmission members into a desired orientation over a selected pigment region. The pigment regions within each pigment cluster optionally are arranged to produce a specific image when the light transmission members are all oriented in a first direction. The pigment regions within each pigment cluster optionally are arranged to produce a specific second image when the light transmission members are all oriented in a second direction.

The member bearing surfaces optionally each include a lateral channel, and the well bearing surfaces each include a lateral well flange extending into the lateral channel of a corresponding light transmission member. The member bearing surfaces alternatively each include a pair of spaced apart lateral member flanges, and the well bearing surfaces each include a lateral well flange extending between the lateral member flanges.

The apparatus optionally additionally includes a member positioning sheet for centering each member light receiving end over any selected pigment region, the member positioning sheet being secured between the pigment sheet and the display board and having a cut-out member positioning port over corresponding the pigment clusters, each positioning port being shaped to define a circumferential series of member capture points into which a member light receiving end can seat, the number of capture points in each positioning port matching the number of pigment regions in each pigment cluster and each capture point is positioned relative to a corresponding pigment region so that one of the light receiving ends seated within a given capture point is substantially centered over a corresponding pigment region. Each capture point preferably is one of: a corner of a positioning port and a lateral notch in a positioning port.

The apparatus optionally additionally includes a member light radiating end moving tool for sweeping over and thereby tilting a number of the member light receiving ends in a selected direction, the moving tool including a tool gripping portion and a member light radiating end contact portion. The member light radiating end contact portion optionally includes a series of laterally spaced apart teeth. The member light radiating end contact portion alternatively includes a semi-spherical deformable and resilient pad. The member light radiating end contact portion still alternatively includes a member tip.

The apparatus optionally additionally includes an apparatus housing containing the light source and having a housing side wall and a housing bottom wall with a housing bottom wall upper face, and glow in the dark paint on the housing bottom wall upper face.

BRIEF DESCRIPTION OF THE DRAWINGS

Various other objects, advantages, and features of the invention will become apparent to those skilled in the art from the following discussion taken in conjunction with the following drawings, in which:

The file of this patent contains at least one drawing executed in color. Copies of this patent with color drawings will be provided by the Patent and Trademark Office upon request and payment of the necessary fee.

FIGS. 9 and 10 are cross-sectional partial front views of the display board and pigment sheet showing two light transmission members contained within two member wells, these light transmission members having circumferential channel member bearing surface and the member well having a well flange well bearing surface, showing narrowed light radiating end shapes which concentrate light intensity at the heads of the member.

FIG. 23 is a side view of the wide tooth comb light transmission member tilting tool.

FIG. 24 is a side view of the hemispherical foam pad assembly light transmission member tilting tool.

DETAILED DESCRIPTION OF THE PREFERRED EMBODIMENTS

Figure 1:
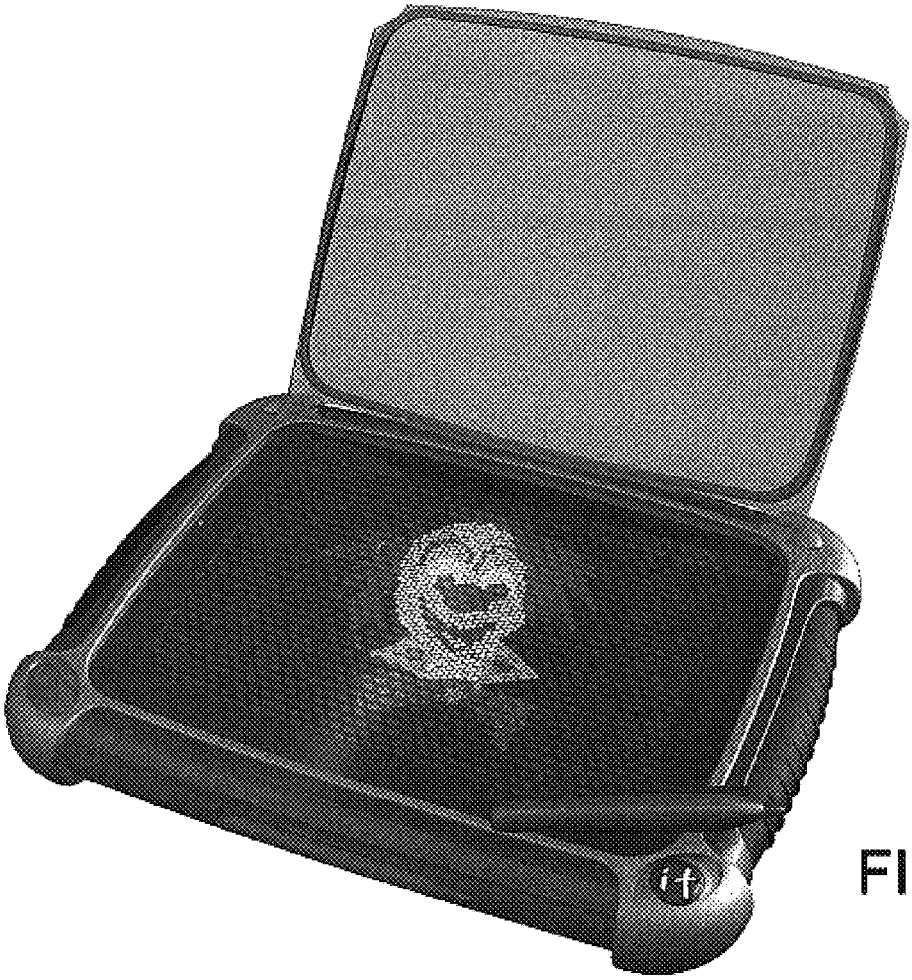
FIG. 1 is a color photograph showing a perspective view of the picture board apparatus with the lid open and a clown image appearing on the display board produced by light passing upwardly through light transmission members tilted to selected positions, and a pen tool resting on a forward corner of the display board for manually tilting the light transmission members.
Figure 2:
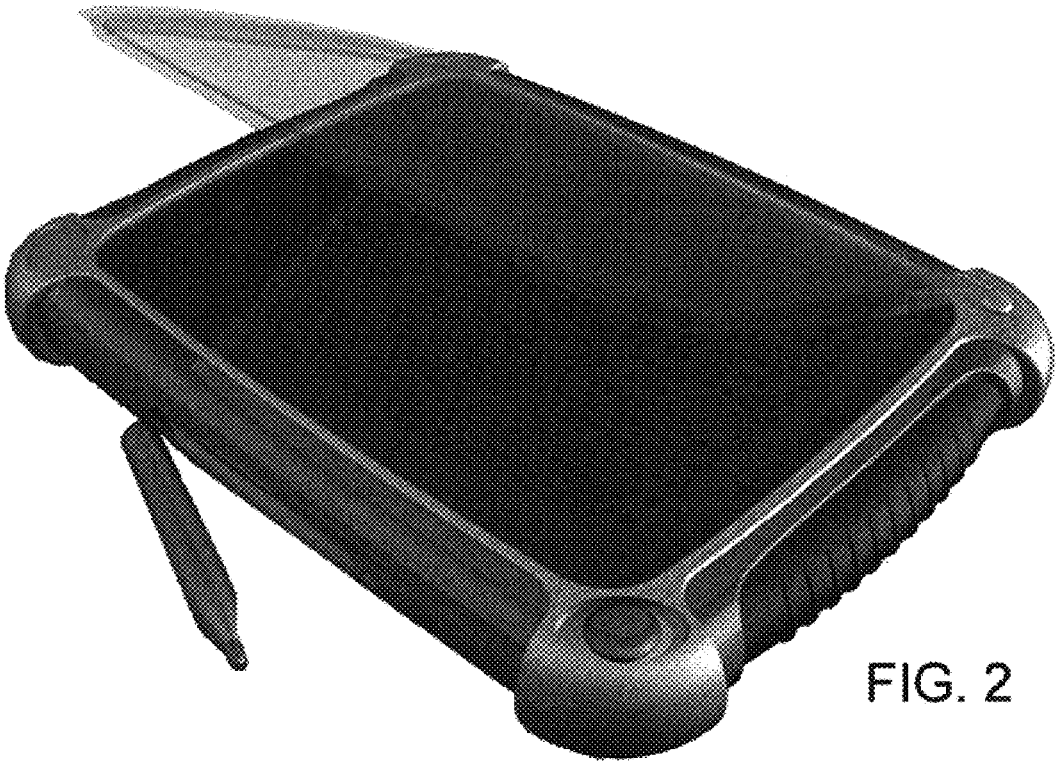
FIG. 2 is a color photograph showing a perspective view of the picture board apparatus of FIG. 1 with the image on the display board cleared so that only black shows through the color transmission members and with the lid partially closed, with the pen tool resting immediately forwardly of the apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring generally to FIGS. 1–24 and specifically to FIGS. 1–6, an image generating apparatus 10 is disclosed including a pigment sheet 40 having an array of pigment clusters 40*a*, each pigment cluster 40*a* being formed of several pigment regions 42, each pigment region 42 containing an individual pigment differing in radiated color from the radiated color of the pigment in another pigment region 42 within the pigment cluster 40*a*, an image display board 12 having an array of light transmission member wells 14 and a translucent colorless light transmission member 16 mounted within each member well 14 such that the light transmission member 16 is movable within the member well 14 relative to the pigment sheet 40 to any one of various light transmission member 16 positions to selectively receive a selected radiated color from one of the pigment regions 42 of the pigment sheet 40. At least one artificial light source 30 is mounted downwardly of the pigment sheet 40 and the pigment sheet 40 is translucent, so that light of a certain color frequency is transmitted into each light transmission member 16 corresponding in color to the particular pigment region 42 immediately adjacent the light receiving area of the particular light transmission member 16. A mounting panel 22 preferably is mounted below and against the pigment sheet 40 to help pigment sheet 40 retain its generally planar shape. Apparatus 10 includes an electric power source 32 electrically connected to the at least one light source 30 through an apparatus circuit 34.

Display board 12 preferably forms the top wall of a housing 20 shaped as a low profile box having housing side walls 24 and a housing bottom wall 26. A hinged lid 18 is pivotally connected to housing 20 to cover and protect display board 12. The artificial light source 30 preferably includes several fluorescent light bulbs secured within the housing 20 along the perimeter of display board 12 and the power source 32 preferably includes several household batteries, but alternatively can include a cord and plug (not shown) for plugging into a standard wall outlet. The upper surface of housing bottom wall 26 preferably is coated with glow in the dark paint 28 which absorbs energy from light source 30 and then glows and radiates light through light transmission members 16 for a length of time after light source 30 is deactivated.

First Preferred Embodiment

For the first embodiment the light transmission member 16 preferably is a light pipe in the form of a light transmitting rod having a member light receiving end 16*a* directed toward the pigment sheet 40 and having a member light radiating end 16*b* directed upwardly from the display board 12, the light receiving end 16*a* and light radiating end 16*b* being separated by a substantially centrally located annular lateral irregularity in the member side wall defining a member bearing surface. See FIGS. 9–12. The light radiating end 16*b* preferably protrudes upwardly for manual pivoting to orient the light transmission member 16 within the member well 14. Each member well 14 further has a tubular well side wall 14*a* extending through the display board 12 and having an annular lateral irregularity defining a well bearing surface within which the member bearing surface is slidably mounted and retained. The flexibility and resilience of the members 16 and display board 14 materials permit each members 16 to be placed in an empty member well 14 and the member bearing surface and the well bearing surface to be forcibly snapped into their mutually engaging relationship.

The pigment clusters 40*a* are formed of translucent pigment material which preferably is a suitable paint or mixture of photographic chemicals. See FIG. 6. The pigment sheet 40 preferably is flexible and transparent and the pigment material is applied to the downward surface of the pigment sheet 40 so that contact between the upward surface of sheet 40 and light transmission members 16 does not abrade the pigment material.

Figure 3A:
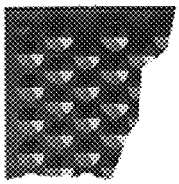
FIG. 3*a* is a color photograph of a broken away portion of the pigment sheet, showing several of the pigment clusters.
Figure 3:
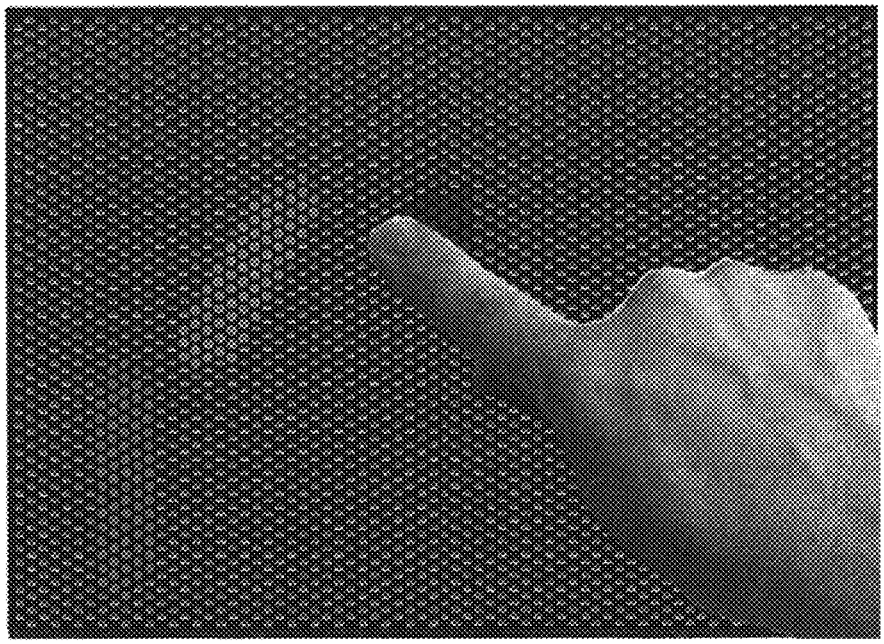
FIG. 3 is a color photograph showing a top view of the apparatus display board with swaths of pegs tilted to pass certain colors, showing how a user can effectively "paint" images by simply sweeping a finger over and tilting selected the light transmission members.
Figure 4A:
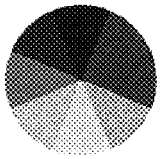
FIG. 4*a* is a color photograph representation of the pigment cluster preferably used to generate the image shown in FIG. 4.
Figure 4:
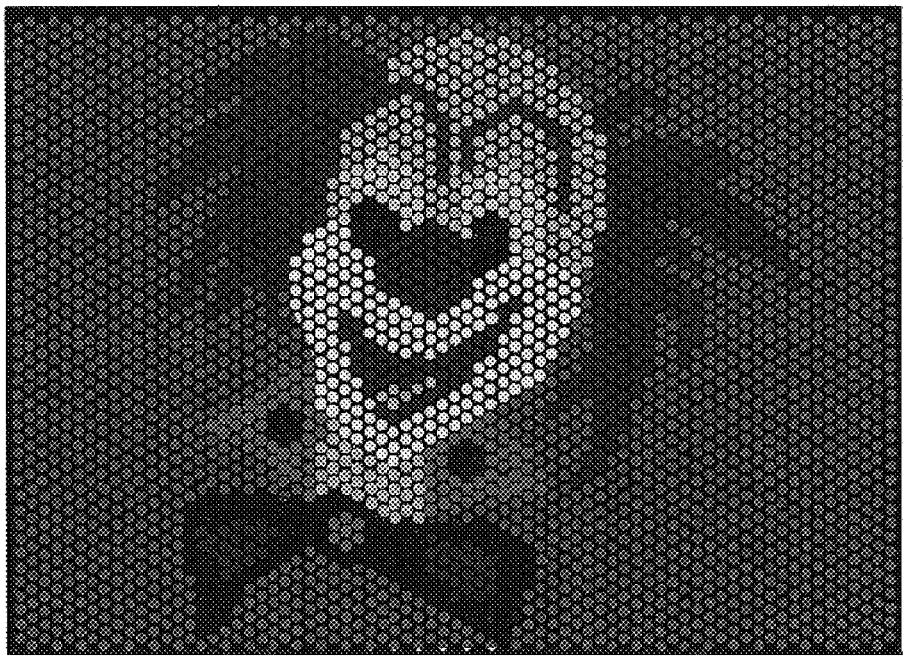
FIG. 4 is color photograph showing a top view of the apparatus display board showing the generated image of FIG. 1.
Figure 5:
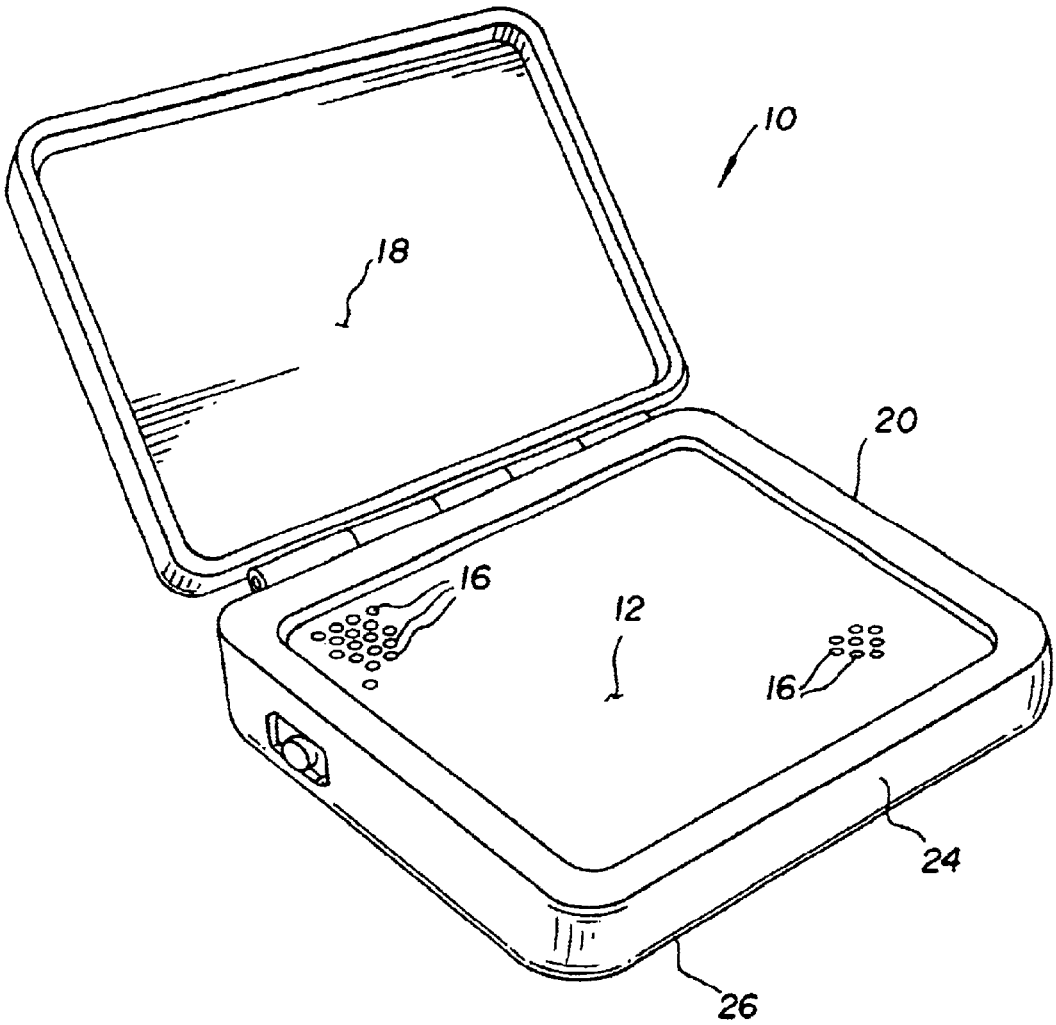
FIG. 5 is an upper perspective view of the apparatus with its lid open.

The pigment regions 42 making up each pigment cluster 40*a* preferably are arranged in radially divided segments arrayed around a center point. See FIGS. 3*a* and 4*a*. For pigment clusters 40*a* having relatively small numbers of pigment regions 42, the pigment regions 42 within each pigment cluster 40*a* preferably are discrete and sharply divided along radial lines, since the pigment regions 42 are large enough relative to the light receiving end 16*a* cross-sectional areas that all of the corresponding member light receiving end 16*a* can be positioned over and within the borders of each given pigment region 42. For pigment clusters 40*a* having relatively large numbers of pigment regions 42, the pigment regions 42 preferably blend each other at the region 42 edges adjacent another pigment region 42 edge, because these pigment regions 42 are not large enough to completely contain the corresponding light receiving end 16*a* and radiated color mixing within light transmission members 16 is minimized.

For high quality image I generation, the cluster 40*a* center point must be centered at the center axis of the corresponding member well 14. To accomplish this, fastener ports 44 are bored through pigment sheet 40 and in the mounting panel 22 behind the pigment sheet 40 at precise locations which register with fastener bores 46 in the display board 12 through which like sized screw fasteners 48 are engagingly inserted, and preferably are located along the peripheries of mounting panel 22, pigment sheet 40 and board 12. See FIG. 6.

Figure 6A:
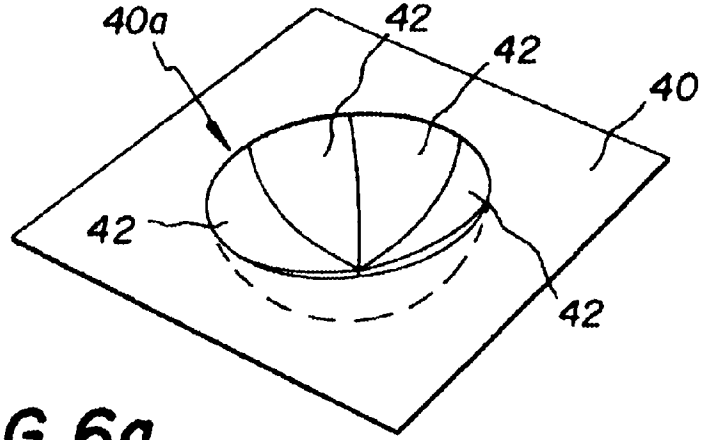
FIG. 6*a* is a perspective view of a portion of the pigment sheet including a concave depression on top of a pigment cluster.
Figure 6:
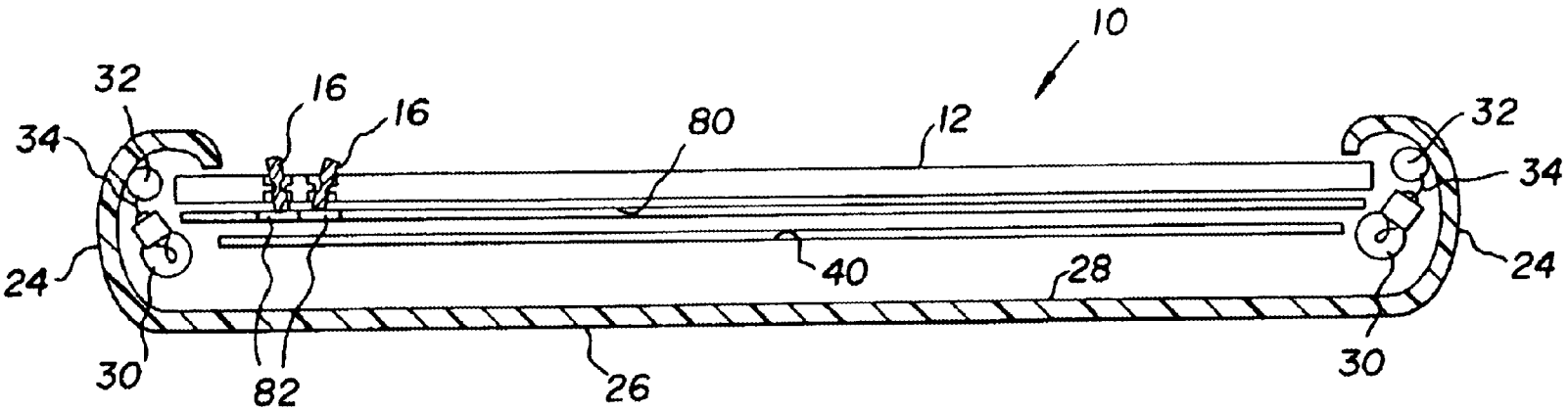
FIG. 6 is a cross-sectional front view of the apparatus showing the light sources, display panel, two representative light transmission members, the pigment sheet and the mounting sheet.
Figure 7:
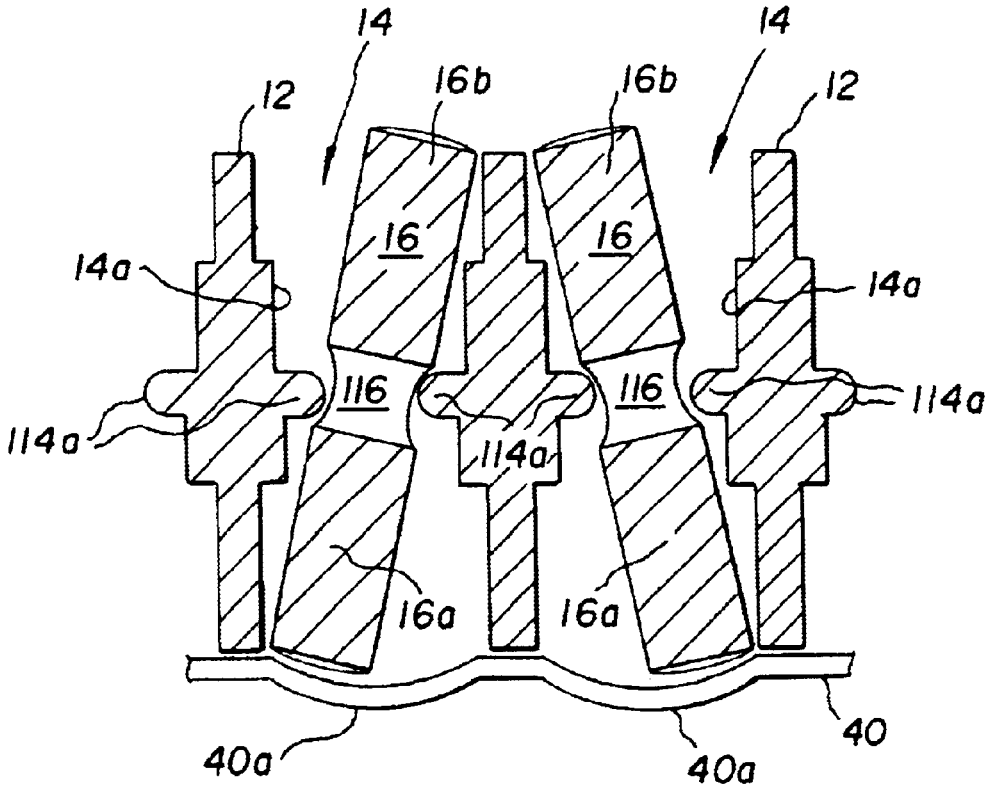
FIG. 7 is a cross-sectional partial front view of the display board and pigment sheet showing two light transmission members contained within two member wells, these light transmission members having circumferential channel member bearing surface and the member well having a well flange well bearing surface.
Figure 8:
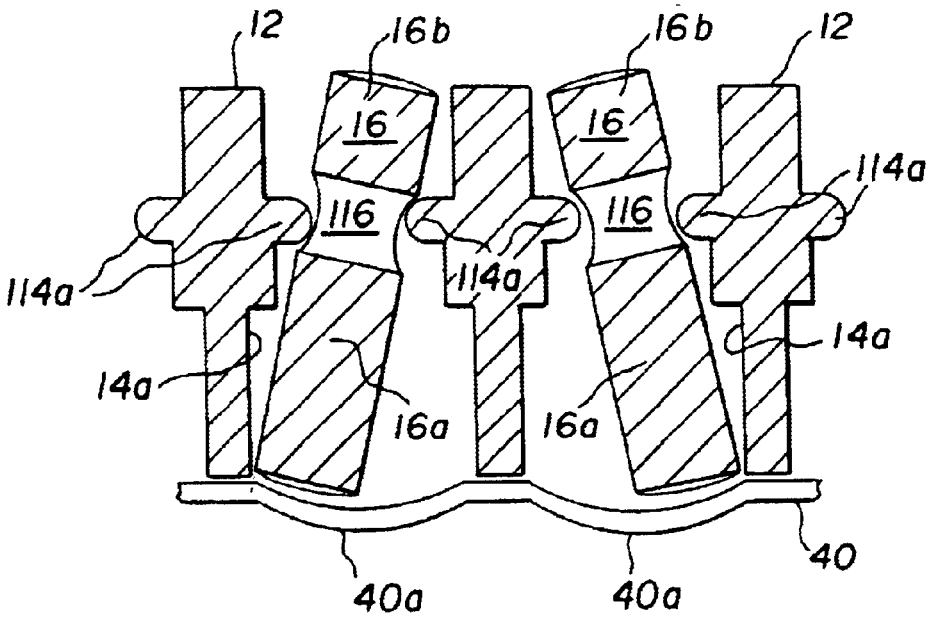
FIG. 8 is a view as in FIG. 7 except that the light transmission members have longer and heavier light receiving ends so that tilting the display board upright uniformly tilts all of the light transmission members in the same direction to clear the display board of all patterns and images.
Figure 11:
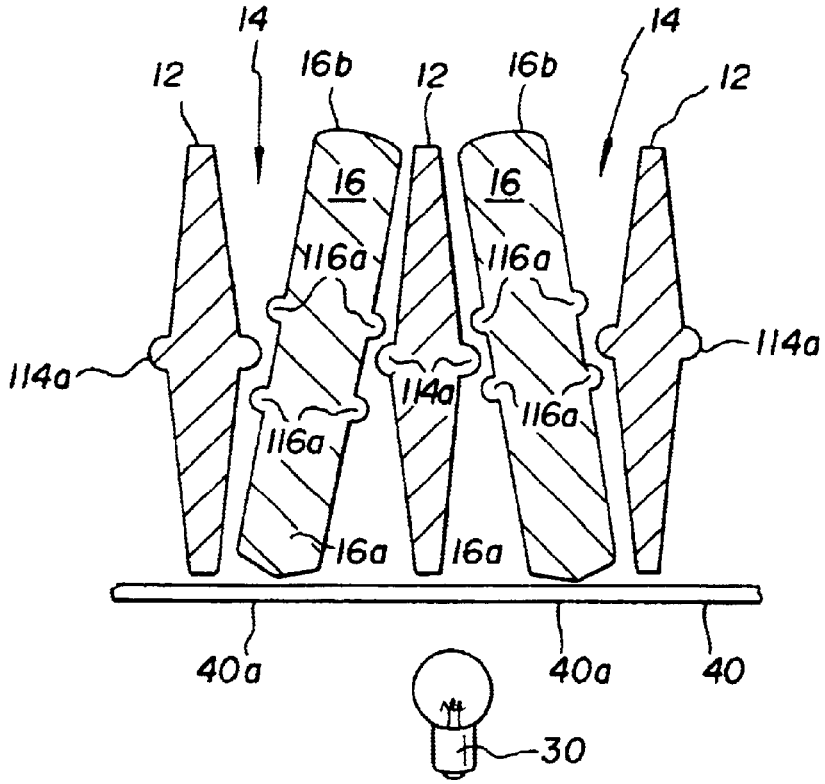
FIG. 11 is a cross-sectional partial front view of the display board and pigment sheet showing two light transmission members contained within two member wells, these light transmission members having one circumferential channel flange bearing surface and the member well having two spaced apart circumferential well flanges receiving between them retaining the channel flange.
Figure 12:
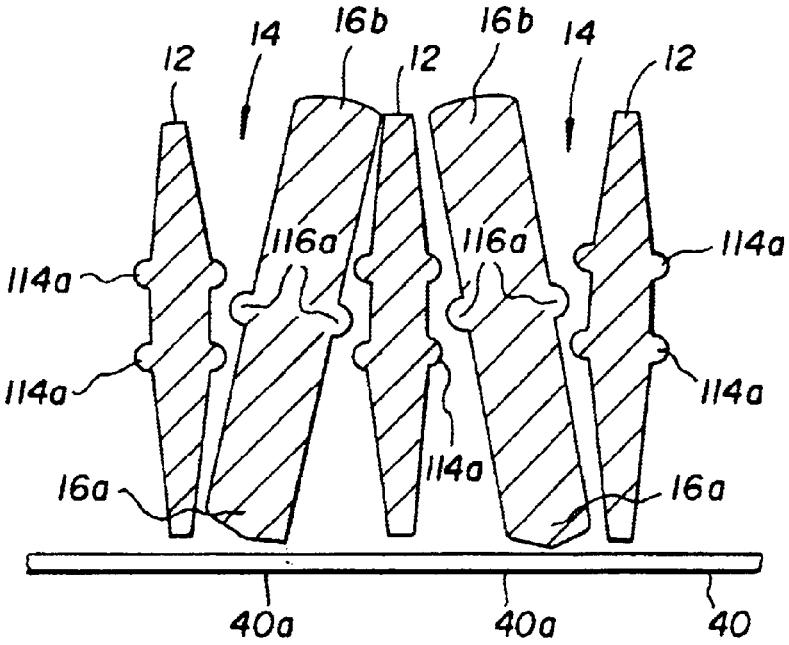
FIG. 12 is a cross-sectional partial front view of the display board and pigment sheet showing two light transmission members contained within two member wells, these light transmission members having two spaced apart circumferential channel flange bearing surfaces and the member well having one circumferential well flange bearing surface fitting between and being retained by the well flanges.
Figure 13:
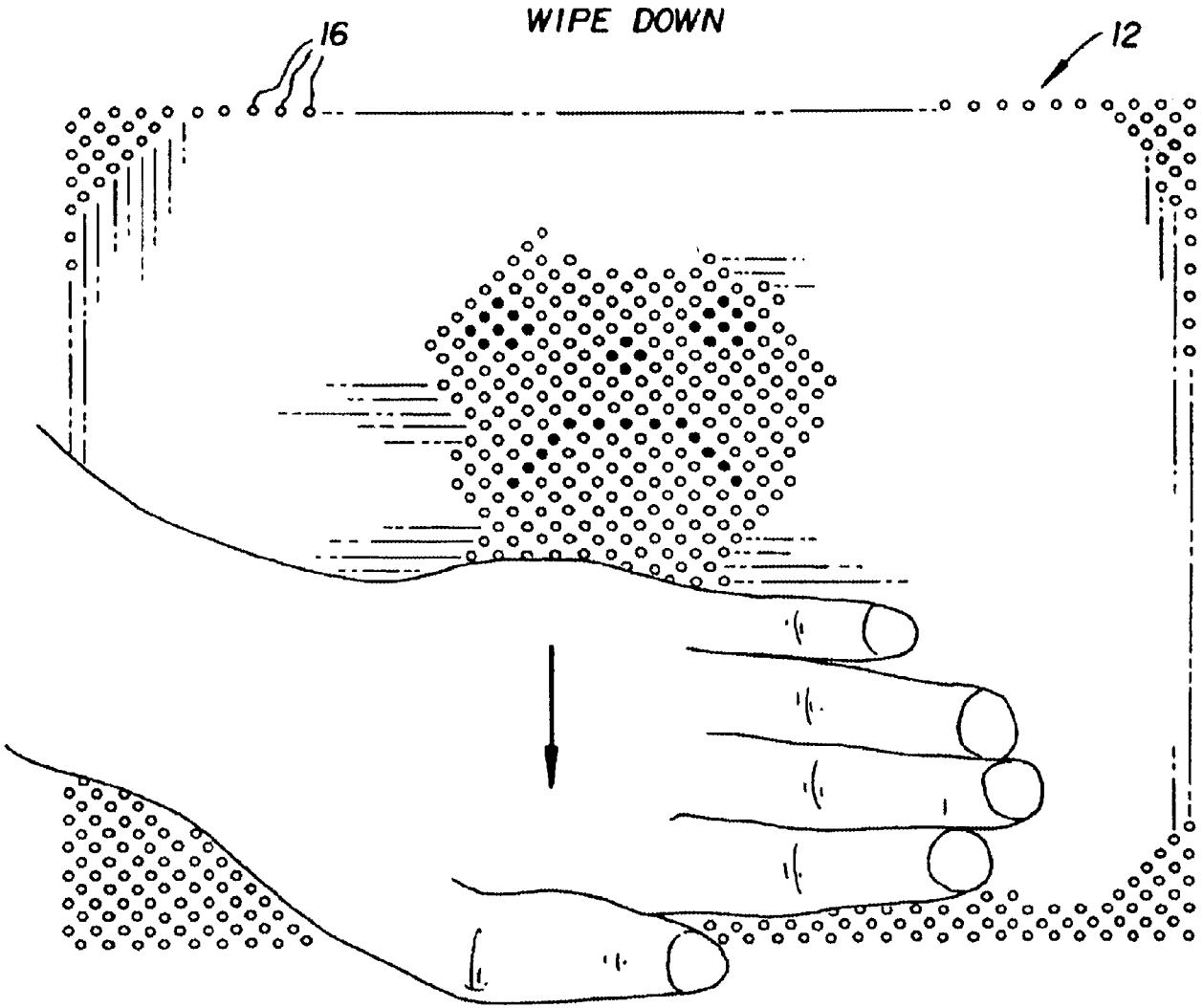
FIG. 13 is a top view of the display board showing a frowning face first image in light transmission members tilted forwardly radiating black surrounded by light transmission members radiating white.
Figure 14:
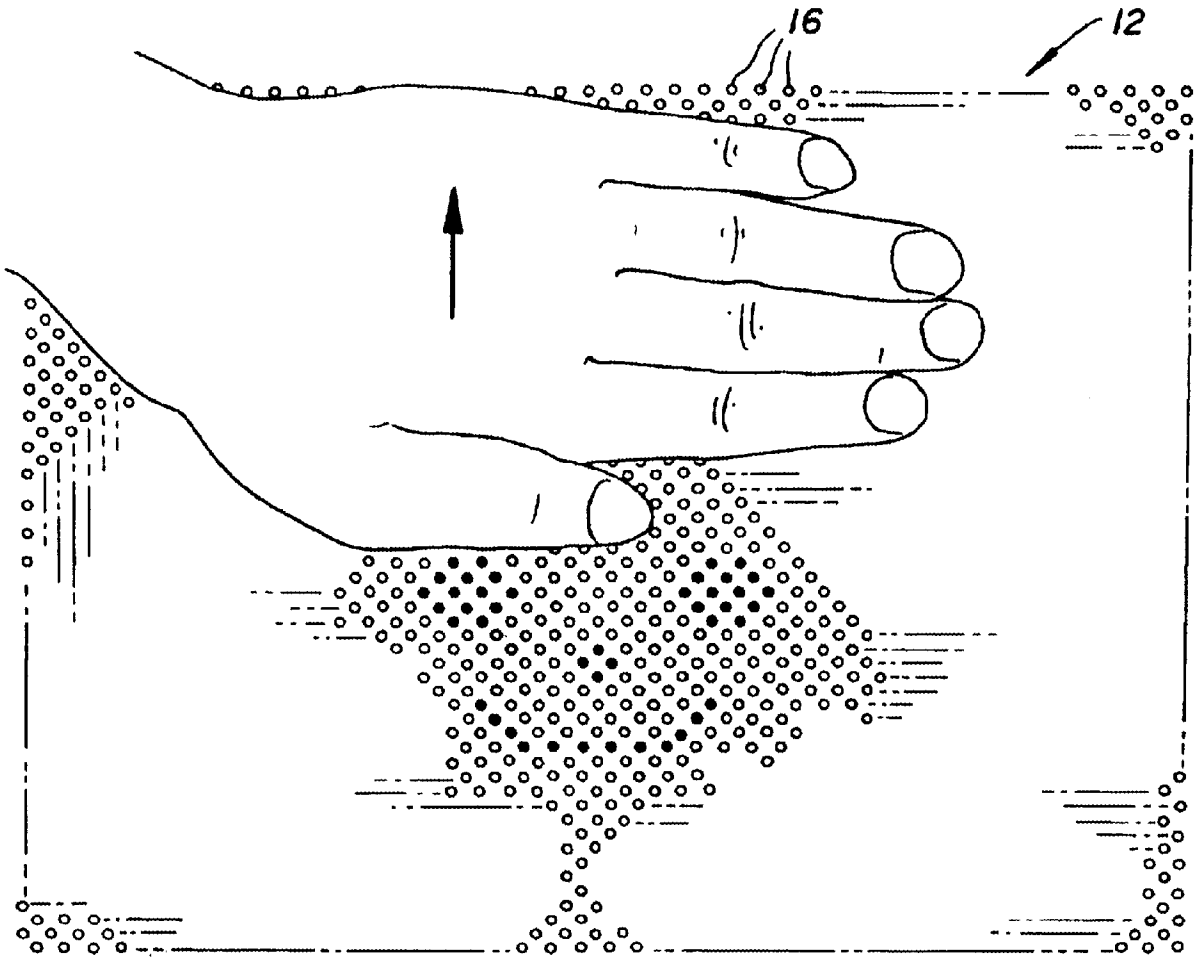
FIG. 14 is a top view of the display board of FIG. 13 showing a smiling face second image in light transmission members tilted rearwardly radiating black surrounded by light transmission members radiating white.
Figure 15:
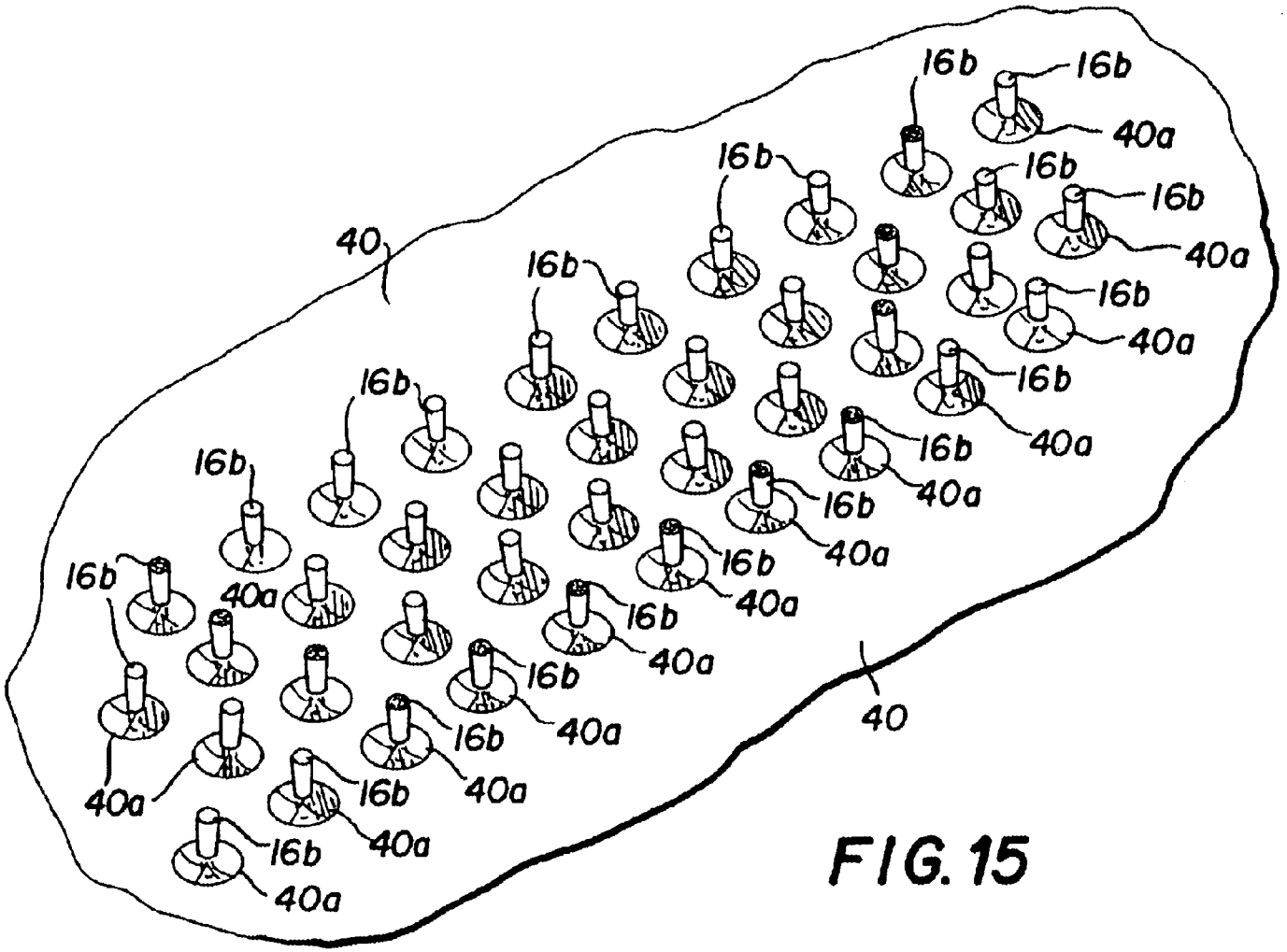
FIG. 15 is a perspective view of a portion of the pigment sheet and several of the light transmission members, showing how the pigments within the pigment clusters can be arranged to program an image into the pigment sheet, to generate an image as shown in FIG. 14.

For one embodiment of pigment sheet 40, the portions of pigment sheet 40 bearing pigment clusters 40*a* are each shaped as a concave spherical segment arching downwardly away from the adjacent light transmission member 16, and having a curvature substantially matching the pivot arch of the light receiving end 16*a*, so that the member end 16*a* is a fixed distance from the pigment cluster 40*a* regardless of its pivotal orientation within the member well 14. See FIGS. 6*a*, 7 and 8. This embodiment permits light transmission member 16 to pivot with minimal friction resistance. The member light receiving ends 16*a* preferably are each either convex or planar to gather as much light as possible. For this embodiment of pigment sheet 40, a mounting panel 22 preferably is secured behind and bears against the rear surface of the pigment sheet 40 to cause the pigment sheet 40 to retain its shape, the mounting panel 22 being substantially rigid and planar, with concave radial depressions positioned and sized to correspond to and receive the concave segment pigment clusters 40*a*.

For another embodiment of pigment sheet 40, pigment sheet 40 is entirely planar, and the member light receiving ends 16*a* rest and ride on the pigment sheet 40 upward surface. See FIGS. 9, 10 and 11. For this embodiment, the member light receiving ends 16*a* preferably are conical, tapering to a narrower cross-section at their tips, so that light transmission members 16 are unstable when standing vertically upright on pigment sheet 40 and readily slide into a tilted position over one of the pigment regions 42 of the pigment cluster 40*a*. For this embodiment of pigment sheet 40, a planar mounting panel 22 preferably is secured behind and bears against the bottom surface of the pigment sheet 40 to cause the pigment sheet 40 to retain its planar shape and support members 16.

The pigment clusters 40*a* preferably include a series of different bright color pigment regions 42 and a black and a white pigment region 42. For purposes of this application, black, and white are referred to as colors. The relative locations of the individual pigment regions 42 may be arranged to accomplish any of a variety of display results.

The pigment clusters 40*a* can be arranged so that the user is free to create any pattern or design he or she happens to imagine. For this objective, pigment regions 42 of the same colors are provided in each pigment cluster 40*a*, and the pigment regions 42 for each given color are oriented in the same direction relative to display board 12 within every pigment cluster 40*a*, for complete cluster 40*a* uniformity. Since clusters 40*a* are all identical, the user knows where the pigment region 42 for each color is located within every cluster 40*a*, and can select the color to be displayed by each individual light transmission member 16. As a result, the user can create entirely original color arrays. The black pigment regions 42 for example can all be positioned in a given direction, such as in the portion of clusters 40*a* oriented toward from the user, so that moving all of the light radiating ends 16*b* of light transmission members 16 in the opposing direction causes a uniformly black image to appear on the display board 12 to effectively clear the board 12. Black is preferred because the other colors do not visibly bleed into the black radiated image from varying viewing angles. To make board 12 clearing more convenient, the light receiving ends 16*a* are preferably made longer and thus heavier than light radiating ends 16*b* so that simply tilting the board 12 upward face is toward the user causes gravity to tilt the light transmission members 16 to all radiate black and thus to clear board 12. See FIGS. 9 and 10.

The pigment clusters 40*a* can be arranged so that the user can create a first pre-arranged image I simply by sweeping his or her hand, or a straight edge of a tool, across display board 12 in a first direction to uniformly tilt members 16 in the first direction, and optionally create a second and different pre-arranged image I by sweeping his or her hand or tool straight edge across display board 12 in a second direction. For this objective, color pigment regions 42 of a specific first color and common position within selected pigment clusters 40*a* are all oriented in a first direction, while color pigment regions 42 of a second color or colors differing from the first color of all other pigment clusters 40*a* are oriented in the first direction. The selected clusters 40*a* are those which are positioned over display board 12 in relative locations which define all or a portion of a desired image I. For purposes of illustration only, the first color is black and the second color is white. See FIGS. 13–15. The pigment regions 42 within the pigment clusters 40*a* can be arranged so that a separate and distinct image I is created for one, two or even every tilt direction of light transmission members 16 which registers with a pigment region 42.

For one embodiment of light transmission members 16, the member bearing surfaces are each a circumferential member channel 116 recessed into the light transmission member 16 side wall, and the well bearing surfaces are each a circumferential well flange 114*a* extending into the circumferential member channel 116 of the corresponding light transmission member 16. See FIGS. 7–10. For another embodiment, the member bearing surfaces are each a pair of spaced apart circumferential member flanges 116*a*, and the well bearing surfaces once again are each a circumferential well flange 114*b* extending into the space between the two circumferential member flanges 116*a*. See FIG. 11. For yet another embodiment, which is not illustrated, the member bearing surfaces are each a circumferential member bulge or flange protruding outwardly from the light transmission member side wall, and the well bearing surfaces are each a circumferential well channel recessed into the well side wall into which the member bulge or flange extends. In each of these cases, the tolerances between member bearing surfaces 116 and 116*a*, and the respective well bearing surface 114*a* and 114*b* define a sliding fit which is loose enough that the light transmission member 16 is free to tilt and pivot laterally within its member well 14 and yet is tight enough to retain the light transmission member 16 within its member well 14. Member and well bearing surface circumferential structures may be continuous or broken into one or more discontinuous circumferential segments. Such segments are referred to generally as being "lateral". It is noted that the lens structure 16 may be a single, monolithic structure in which the light transmitting rod portion and the lens bearing surface 16*a* are formed as a single unit, or may be a composite structure constructed of multiple individually formed parts.

Figure 16:
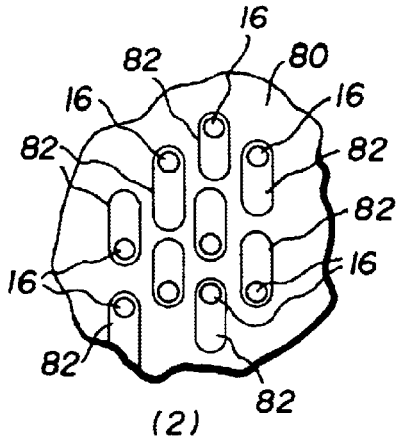
FIG. 16 is a bottom view of a portion of the optional member positioning sheet with positioning ports having two member capture points.
Figure 17:
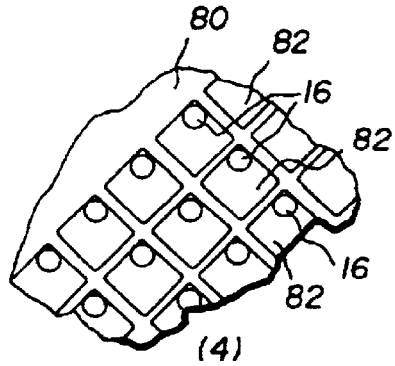
FIG. 17 is a bottom view of a portion of the optional member positioning sheet with positioning ports having four member capture points.
Figure 18:
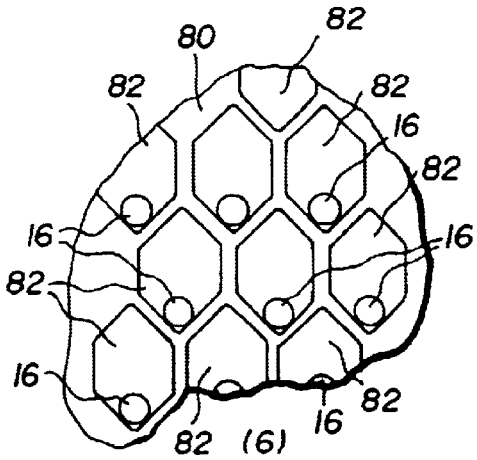
FIGS. 18–20 are a bottom views of a portion of the optional member positioning sheet with positioning ports having four member capture points.
Figure 19:
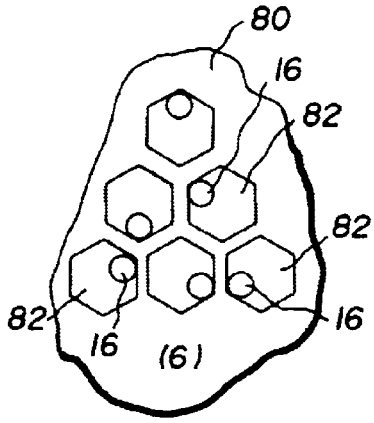
Figure 20:
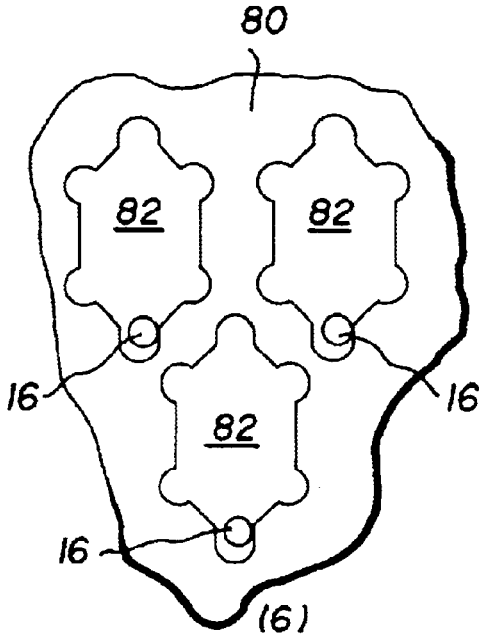
Figure 21:
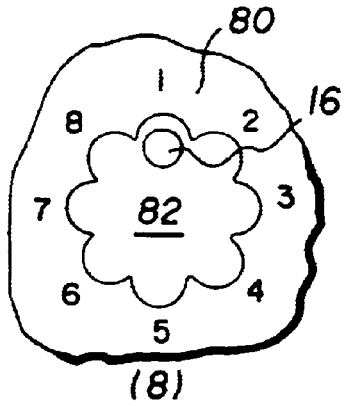
FIG. 21 is a bottom view of a portion of the optional member positioning sheet with positioning ports having eight member capture points.
Figure 22:
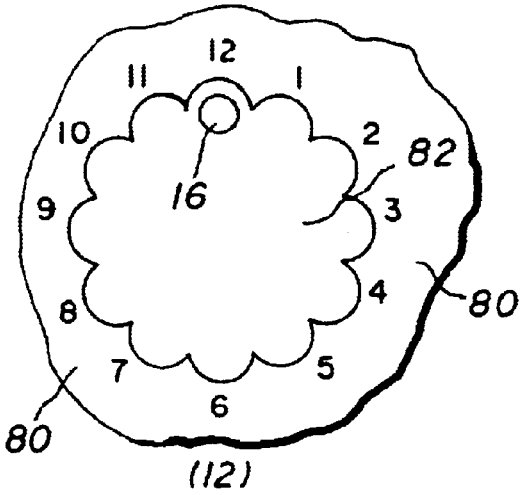
FIG. 22 is a bottom view of a portion of the optional member positioning sheet with positioning ports having twelve member capture points arranged as are numbers on the face of a clock.

A member positioning sheet 80 preferably is provided for centering the member light receiving ends 16*a* over any selected pigment region 42. The member positioning sheet 80 is preferably secured between pigment sheet 40*a* and display board 12 and has a cut-out member positioning port 82 centered over each pigment cluster 40*a*. Each positioning port 82 is shaped to define a circumferential series of member capture points, preferably in the form of port corners 84 or port notches 86 into which the light receiving end 16*a* of the given member 16 seats. The number of capture points in each positioning port 82 matches the number of radial pigment regions 42 in each pigment cluster 40*a* and each capture point is positioned relative to a corresponding pigment region 42 such that a light receiving end 16*a* is positioned within the given capture point to be centered over the given pigment region 42. Any of a wide number of pigment regions 42 and corresponding capture points may be provided. For several examples, the number may be two, as shown in FIG. 16, four as shown in FIG. 17, six as shown in FIGS. 18, 19 and 20, eight as shown in FIG. 21 or twelve as shown in FIG. 22. Twelve is one preferred number, because specific pigment regions 42 can be located by matching them with conventional clock locations. Positioning sheet 80 preferably is secured between pigment sheet 40 and display board 12 with screw fasteners 48 passing through fastener ports 44 in member positioning sheet 80 and through registering fastener ports 44 in pigment sheet 40. It is alternatively contemplated that positioning sheet 80 be secured to the display board 12 upper surface so that the positioning port 82 capture points engage and position the light radiating ends 16*b* of members 16.

Various tools are provided for manipulating the light transmission members 16 to produce various desired color patterns on display board 12. One such tool is a wide tooth comb 100 in the form of an elongate panel having a longitudinal gripping edge 102 and a longitudinal tooth edge 104 including a series of wide end teeth 106 separated by notches, the teeth 106 preferably being formed of a deformable, resilient foam material. See FIG. 23. Sweeping the teeth 106 over member light radiating ends 16*b* causes all contacted light radiating ends 116*a* to pivot in a selected first direction to produce a stripped image I. Subsequently sweeping the teeth 106 over the light radiating ends 116*a* in a second direction perpendicular to the first direction produces a checkerboard image I.

Another tool is a hemispherical foam pad assembly 110 which includes a semi-spherical deformable and resilient pad 112 mounted on a handle member 114. See FIG. 24. Placing the pad 112 against the light radiating ends 16*b* and rotating pad 112 about its vertical axis pivots members 16 into a pattern which produces an image I with an attractive swirl of colors. Pressing pad 112 more firmly against display board 12 flattens pad 112 to widen the circular area of pad 112 contact with light radiating ends 16*b* to increase the diameter of the color swirl in image I. Pad 112 can also be swept across display board 12 along a rectilinear or curvilinear path to display board 12 to pivot members 16 to produce a swath of substantially uniform color or of progressively shifting colors. The width of the swath is made wider by depressing pad 112 more firmly against display board 12 to present a broader flat surface and is made narrower by lessening pad 112 pressure.

Another tool is a stick or pen 120 which can be swept across display board 12 to produce a rectilinear or curvilinear path which is relatively thin and is uniform in width. See FIG. 1. Pen 120 preferably is cylindrical and has a flat broad contact end.

Templates (not shown) are optionally provided which are sheets of material having cut-out areas which are placed on top of the display board 12 so that only select light transmission members 16 are exposed through the cut-outs. Then a user hand or tool can be passed over the template so that only light transmission members 16 exposed through the cut-outs are contacted by the hand or tool and pivoted, resulting in an image I corresponding in configuration to the shapes of the cut-outs.

Method

In practicing the invention, the following method may be used. The player pivots members 16 one by one, or in clusters simultaneously and sequentially with a sweep of the hand or tool, until each is illuminated with a selected color and member 16 are collectively illuminated with colors forming a desired pattern or picture.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An image generating apparatus, comprising:

a pigment sheet having an array of translucent pigment clusters, each said pigment cluster being formed of a plurality of pigment regions, each said pigment region containing an individual pigment differing in radiated color from that of a pigment in another said pigment region within the pigment cluster;

an image display board perforated by an array of light transmission member wells and positioned above said pigment sheet such that said member wells are located over and substantially register with a corresponding said pigment cluster;

a plurality of translucent light transmission members, each light transmission member being mounted within one of said member wells such that each said light transmission member is movable within its corresponding said member well relative to said pigment sheet to any one of various light transmission member positions to selectively receive a selected radiated color from one of said pigment regions, each said light transmission member comprising a member side wall and a light pipe in the form of a light transmitting rod having a member light receiving end directed toward said pigment sheet and having a member light radiating end directed upwardly from said display board, for manual pivoting to orient the light transmission member within its member well; said light receiving end and said light radiating end being separated by said member side wall, each said member well additionally comprising a tubular well side wall extending through said display board and member pivotal mounting means mounting and retaining said member within said member well;

and at least one artificial light source mounted below said pigment sheet;

such that light of a certain color frequency is transmitted into each said light transmission member corresponding in color to a particular said pigment region immediately adjacent to a particular said light transmission member.

2. The apparatus of claim 1, wherein said member pivotal mounting means comprises a lateral irregularity in said member side wall defining a member bearing surface;

and an annular lateral irregularity defining a well bearing surface within which said member bearing surface is pivotably mounted and retained.

3. The apparatus of claim 1, wherein said pigment clusters comprise translucent pigment material.

4. The apparatus of claim 3, wherein said pigment sheet has a sheet top surface and a sheet bottom surface and is transparent and wherein said pigment material is applied to the sheet bottom surface such that contact between said sheet top surface and said light transmission members does not abrade said pigment material.

5. The apparatus of claim 2, wherein said pigment regions forming each said pigment cluster are arranged in radially divided segments arrayed around a center point.

6. The apparatus of claim 5, wherein said pigment regions within each said pigment cluster are discrete and sharply divided along radial lines.

7. The apparatus of claim 5, wherein said pigment regions blur over and into each other at edges of said pigment regions adjacent an edge of another said pigment region.

8. The apparatus of claim 2, wherein portions of said pigment sheet directly above said pigment clusters are each shaped as a concave and semi-spherical segment arching downwardly away from said light transmission member, and having a curvature substantially matching a pivot arch of the light receiving end of the corresponding said light transmission member, such that said light receiving end remains a substantially fixed distance from the corresponding said pigment cluster and the corresponding said light transmission member pivots with minimal friction resistance.

9. The apparatus of claim 8, wherein said member light receiving ends are one of: convex and planar to gather as much light as possible through a given said pigment region.

10. The apparatus of claim 8, wherein a mounting panel is secured behind and bears against said pigment sheet to cause the pigment sheet to retain its shape;

and wherein said mounting panel is substantially rigid and planar, and has concave radial depressions positioned and sized to correspond to and receive said concave and semi-spherical segments and said pigment clusters.

11. The apparatus of claim 2, wherein said pigment sheet is planar, and said member light receiving ends each rest and ride on said pigment sheet, and wherein each said member light receiving end tapers to a tip of reduced diameter relative to a remainder of a corresponding said light transmission member, to be unstable when resting in a vertical position on said pigment sheet.

12. The apparatus of claim 11, wherein a mounting panel is secured behind and bears against said pigment sheet to cause said pigment sheet to retain its shape, and wherein said mounting panel is substantially rigid and planar; and wherein said mounting panel is secured behind and bears against said pigment sheet to cause said pigment sheet to retain a planar shape.

13. The apparatus of claim 5, wherein pigment regions of the same colors are provided in each said pigment cluster, and the pigment regions for each given color are oriented in a same direction within every pigment cluster for cluster uniformity.

14. The apparatus of claim 13, wherein each said light receiving end is longer and therefore heavier than each said light radiating end such that tilting said apparatus causes gravity to tilt said light transmission members into a desired orientation over a selected pigment region.

15. The apparatus of claim 5, wherein said pigment regions within each said pigment cluster are arranged to produce a specific image when said light transmission members are all oriented in a first direction.

16. The apparatus of claim 15, wherein said pigment regions within each said pigment cluster are arranged to produce a specific second image when said light transmission members are all oriented in a second direction.

17. The apparatus of claim 2, wherein said member bearing surfaces each comprise a lateral channel, and wherein said well bearing surfaces each comprise a lateral well flange extending into said lateral channel of a corresponding said light transmission member.

18. The apparatus of claim 2, wherein said member bearing surfaces each comprise a pair of spaced apart lateral member flanges, and wherein said well bearing surfaces each comprise a lateral well flange extending between said lateral member flanges.

19. The apparatus of claim 5, additionally comprising a member positioning sheet for centering each said member light receiving end over any selected said pigment region, said member positioning sheet being secured between said pigment sheet and said display board and having a cut-out member positioning port over corresponding said pigment clusters, each said positioning port being shaped to define a circumferential series of member capture points into which a member light receiving end can seat, a number of said capture points in each said positioning port matching a number of said pigment regions in each said pigment cluster and wherein each said capture point is positioned relative to a corresponding said pigment region such that one of said light receiving ends seated within a given said capture point is substantially centered over a corresponding said pigment region.

20. The apparatus of claim 19, wherein each said capture point is one of: a corner of a positioning port and a lateral notch in a positioning port.

21. The apparatus of claim 5, additionally comprising a member light radiating end moving tool for sweeping over and thereby tilting a plurality of said member light receiving ends in a selected direction, said moving tool comprising a tool gripping portion and a member light radiating end contact portion.

22. The apparatus of claim 21, wherein said member light radiating end contact portion comprises a series of laterally spaced apart teeth.

23. The apparatus of claim 21, wherein said member light radiating end contact portion comprises a semi-spherical deformable and resilient pad.

24. The apparatus of claim 21, wherein said member light radiating end contact portion comprises a member tip.

25. The apparatus of claim 1, additionally comprising an apparatus housing containing said light source and having a housing side wall and a housing bottom wall with a housing bottom wall upper face, and glow in the dark paint on said housing bottom wall upper face.

26. An image generating apparatus, comprising:

an image display board perforated by an array of light transmission member wells;

a plurality of translucent light transmission members, each light transmission member being mounted within one of said member wells such that each said light transmission member is movable within its corresponding said member well, each said light transmission member comprising a member side wall and a light pipe in the form of a light transmitting rod having a member light receiving end directed toward said pigment sheet and having a member light radiating end directed upwardly from said display board, for manual pivoting to orient the light transmission member within its member well; said light receiving end and said light radiating end being separated by said member side wall, each said member well additionally comprising a tubular well side wall extending through said display board and member pivotal mounting means mounting and retaining said member within said member well;

and at least one light source positioned in spaced relation to said image display board;

a translucent pigment cluster positioned between said at least one light source and each of said light transmission members, said translucent pigment cluster comprising a plurality of pigment regions, each said pigment region containing an individual pigment differing in radiated color from that of a pigment in another said pigment region within the translucent pigment cluster, such that light from said at least one light source is radiated selectively through at least one said pigment region into a corresponding said light transmission member, thereby illuminating at least a portion of a corresponding said light transmission member with light of the pigment of the at least one said pigment region, and such that movement of the corresponding said light transmission member within its member well selects the at least one said pigment region through which light from said at least one light source is radiated into the corresponding said light transmission member.

* * * * *